United States Patent [19]

Gebelius

[11] Patent Number: 4,566,300

[45] Date of Patent: Jan. 28, 1986

[54] METHOD FOR THE MANUFACTURE OF A CONICAL TUBULAR MEMBER

[76] Inventor: Sven R. V. Gebelius, Drottningholmsvägen 195, Bromma, Sweden, S-161 36

[21] Appl. No.: 557,139

[22] PCT Filed: Mar. 25, 1983

[86] PCT No.: PCT/SE83/00110

§ 371 Date: Oct. 27, 1983

§ 102(e) Date: Oct. 27, 1983

[87] PCT Pub. No.: WO83/03374

PCT Pub. Date: Oct. 13, 1983

[30] Foreign Application Priority Data

Mar. 26, 1982 [SE] Sweden ..... 8201959

[51] Int. Cl.[4] ..... B21D 15/03

[52] U.S. Cl. ..... 72/63; 72/370

[58] Field of Search ..... 72/60, 63, 208, 370, 72/283

[56] References Cited

U.S. PATENT DOCUMENTS

| | | | |
|---|---|---|---|
| 1,215,061 | 2/1917 | Rice et al. . | |
| 1,378,442 | 5/1921 | Chalfant . | |
| 1,605,828 | 11/1926 | Frahm | 72/208 |
| 1,664,629 | 4/1928 | Kielberg | 72/370 |
| 2,568,730 | 9/1951 | Guthmann | 72/208 |
| 3,487,673 | 1/1970 | House | 72/283 |
| 3,570,297 | 3/1971 | Matthews | 72/370 |

FOREIGN PATENT DOCUMENTS

| | | |
|---|---|---|
| 178675 | 3/1962 | Sweden . |
| 1448901 | 9/1976 | United Kingdom . |

*Primary Examiner*—Lowell A. Larson

*Attorney, Agent, or Firm*—Holman & Stern

[57] ABSTRACT

Method for the manufacture of a conical tubular member, and a conical tubular member manufactured according to the method, wherein as a first step a tubular member is formed having inwardly directed profilings (2, 2', 3, 3'), and said member thereafter is placed over a core with grooves arranged to receive said profilings (2, 2', 3, 3') and having a conical shape substantially corresponding to the internal shape of the member to be manufactured. By means of hydraulically and/or pneumatically applied force, divided over the surface of the tubular member by means of at least one flexible pressure applying member arranged surrounding the tubular member, said member is thereafter formed into a conical shape corresponding to the shape of the core, the reduction in diameter of the member being compensated for by means of a change in the shape of the profilings (2, 2', 3, 3'). The member is advantageously manufactured from a material having through perforations, or a wire mesh material.

9 Claims, 7 Drawing Figures

METHOD FOR THE MANUFACTURE OF A CONICAL TUBULAR MEMBER

CROSS REFERENCE TO RELATED APPLICATION(S)

This U.S. application stems from PCT International Application No. PCT/SE83/00110 filed Mar. 25, 1983.

BACKGROUND OF THE INVENTION

1. Field of the Invention

The present invention relates to a method for the manufacture of a conical tubular member, and a member manufactured according to the method.

2. Description of the Prior Art

For a number of different applications, there is a need for tubular elements, having a conically reduced cross-section in the longitudinal direction, for example for use as poles and masts, flag-poles, and for many other fields of application. Such tubular members, having a substantially cylindrical cross-sectional configuration, can be manufactured by rather expensive manufacturing methods, e.g. by means of a drawforming operation in connection with a draw plate having a variable diameter.

Within many fields of application, it is not of primary importance that a conically tapered tubular member is arranged with a substantially circular cross-sectional configuration, but other cross-sectional configurations are acceptable, and for certain applications also more desirable. The present invention relates to such tubular and conical members, which include longitudinally extending embossings or corrugations. Conical tubular members of this type have previously been manufactured in various fashions, and a first example is disclosed in British Pat. No. 7,754 of 1902, according to which patent a rectangular and plane blank first is arranged with substantially parallel corrugations extending from one edge portion, and with a successively reduced depth in direction from said edge portion. These corrugations change the shape of the plane blank in such a way, that it thereafter can be bent into a conical and tubular member. An alternative method of manufacture is based on the use of a cylindrical and tubular member as basic material, and that embossing rollers produce longitudinally extending corrugations or embossings in the tubular material, and examples of this manufacturing method are shown in British Pat. No. 1,462,370 and French Pat. No. 1,260,814. Previously known methods of manufacture are thus based on two alternative blanks, either a plane blank, which in plane condition is arranged with parallel embossings having a succesively decreased depth, or a cylindrical and tubular member, which is brought into contact with embossing tools to accomplish longitudinally extending corrugations or embossings, when said tools are moved along the cylindrical and tubular member. To use a pre-shaped plane blank can be regarded as an acceptable method of manufacture, when the conical and tubular member to be manufactured has a relatively small length, and preferably also a relatively large angle of taper. However, to use a cylindrical tubular member as a blank, and to use embossing rollers which when moved in longitudinal direction of the member also succesively move towards the center axis of the member, is a method of manufacture that requires extremely complicated and thus also expensive machinery equipment, and it is also impossible to accomplish an end product, in which opposed sides of embossed or corrugated portions contact each other, unless the corrugated tubular member in a final operation is made subject to pressure applied against the outer surface in order to further reduce the diameter. A further problem is the spring return force of the material, and the difficulties in accomplishing substantially U-shaped embossings, having sharp corner portions at the bottom surfaces of the corrugations, and having side and bottom surfaces extending substantially plane.

BRIEF SUMMARY OF THE INVENTION

The object of the present invention is to provide a method for the manufacture of a conical tubular member, suitable for manufacture of such members having a substantial length, with the longitudinally extending corrugations arranged to accomplish maximum rigidity for the manufactured conical member. The resulting end product has exceptionally good rigidity and favorable tensile properties, and also other advantageous properties, which will be more fully discussed later.

BRIEF DESCRIPTION OF THE DRAWINGS

The method according to the present invention, and conical tubular members manufactured according to the method, are more fully described below with reference to the accompanying drawings, wherein.

DETAILED DESCRIPTION

Figure 1:
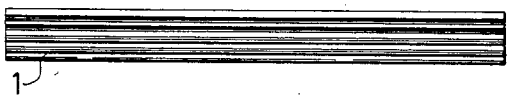
FIG. 1 is a side elevational view of a tubular blank, having a substantially uniform cross-section in longitudinal direction.
Figure 2:
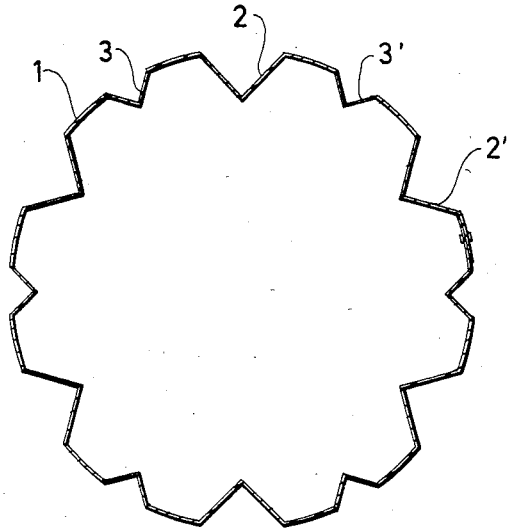
FIG. 2 is a cross-sectional view in enlarged scale of the blank shown in FIG. 1.
Figure 3:
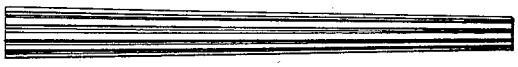
FIG. 3 is a side elevational view of a conical tubular member, formed from the blank shown in FIGS. 1 and 2.
Figure 4:
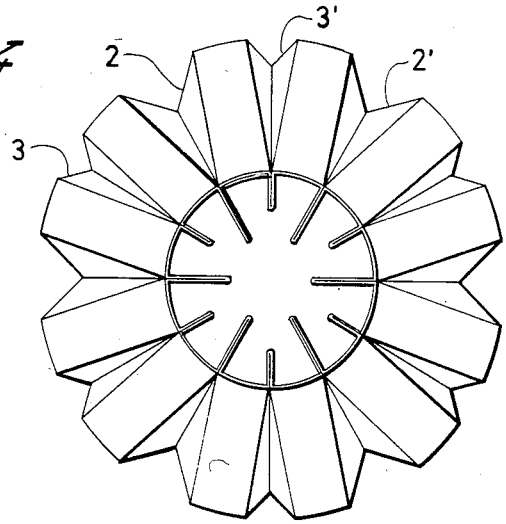
FIG. 4 is an end view in enlarged scale of the tubular conical member shown in FIG. 3, viewed from the end portion having the smallest cross-sectional configuration.

In the method according to the present invention a substantially plane corrugated strip member is bent to form a profiled tubular member 1, having a substantially uniform cross-section in longitudinal direction, as shown in FIGS. 1 and 2. The longitudinally extending edge portions of the strip used as a blank can, as shown in FIG. 2, be arranged overlying each other, and the overlying edge portions can be joined together by rivets, welding or any other suitable method, and obviously also by means of a folded seam.

The profiled tubular member 1 can, as shown, include substantially V-shaped profilings 2, 2', 3, 3', i.e. profilings 2, 2' having a larger depth and profilings 3, 3' having a smaller depth arranged in its intermediate positions between the deeper profilings 2, 2'. Also other types of profilings can obviously be used, e.g. V-shaped profilings having a uniform depth, U-shaped profilings, as well as other types of profilings which facilitate a change in the width of the profiling at least at the portions which coincide with the outer surface of the member 1.

The tubular member 1 is thereafter placed in a position embracing a conical core or mandrel 4, restricted outwardly by means of longitudinally extending contact surfaces 5, 5', separated from each other by means of longitudinally extending grooves 6, 6'. The contact surfaces 5, 5' are intended to serve as contact surfaces for the internal surfaces of the outer portions of the tubular member 1 during a later forming operation, whereas the intermediately located grooves 6, 6' are arranged to receive existing profilings 2, 2', 3, 3' of the tubular member 1.

Figure 6:
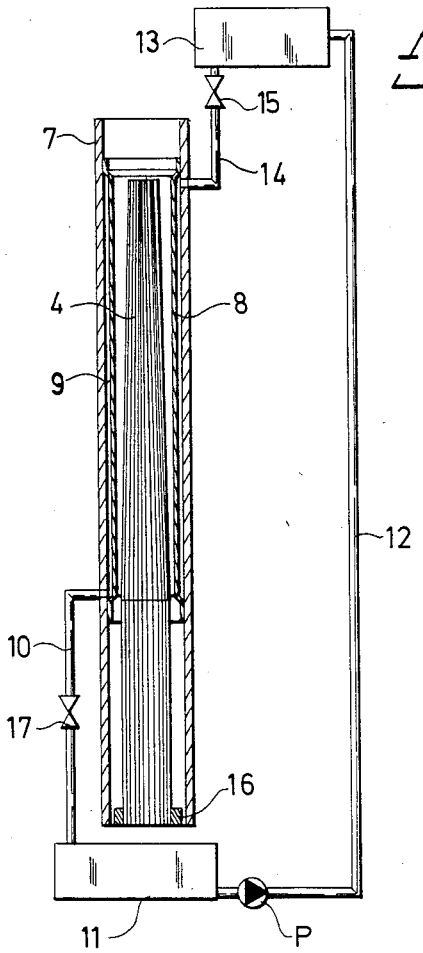
FIG. 6 is a schematic view of an example of a device used when manufacturing according to the method of the invention.

In order to press the tubular member 1 against the conical core 4, the present invention uses hydraulic or pneumatic pressure application, and a schematical example of such a method will now be disclosed with reference to FIG. 6.

FIG. 6 shows a surrounding tubular part 7, to the inside surface of which a flexible hose-shaped member 8 is attached at its free end portions, thus forming an expandable and longitudinally extending chamber 9. The lower portion of chamber 9 communicates via an outlet pipe 10 with a lower tank 11. Adjacent to the lower tank 11 a pump means P is arranged to pump liquid via pipe 12 from the lower tank 11 to an upper tank 13. Finally, upper tank 13 communicates with the upper portion of the chamber 9 via a pipe 14, and in this pipe 14 is also a valve means 15 is arranged, intended to facilitate interruption of the flow communication between the upper tank 13 and the chamber 9. Centrally located within the portion of the tubular part 7 which is restricted by the chamber 9, a core 4 is arranged, and in this embodiment the core 4 is arranged with a first portion having a cross-sectional configuration substantially corresponding to the internal cross-sectional configuration of the profiled tubular member 1. Said first portion is located adjacent to the lower tank 11, changing in direction towards the upper tank 13 into a conically reduced part, having a conicity corresponding to the conicity for the end product. Adjacent to the lower portion of the core 4, an abutment member 16 is shown, preferably arranged movable upwardly along the core 4.

The embodiment of a device for utilization of the method according to the present invention is arranged in use to extend vertically, e.g. located below the surface level in a downwardly directed hole or shaft. Furthermore, the upper tank 13 is filled with water or other liquid medium, and the valve means 15 is closed. If the valve means 15 is opened, liquid flows from the upper tank 13 via the pipe 14 and the chamber 9 to the outlet pipe 10, and thus to the lower tank 11. When the upper tank 13 has been almost emptied, the valve means 15 is closed again, whereby a vacuum is created in the chamber 9. Said vacuum causes the hose-shaped and flexible member 8 to be pressed into a contact position against the internal surface of the tubular part 7.

A profiled tubular member 1 is thereafter inserted into the tubular part 7 in such a way, that said member 1 surrounds the core 4. The abutment member 16 should now be located adjacent to the lower portion of the core 4, whereby only a first and upper portion of the member 1 is located by a first portion of the conical part of the core 4. Thereafter, the valve means 15 is opened, which previously has caused the flexible member 8 to be pressed against the tubular part 7, and said flexible part 8 is thereby moved to a more adjacent position to the inserted profiled member 1. The valve means 15 can now be closed again, and by means of the pump P liquid is now pumped up from the lower tank to the upper tank 13.

A valve means 17 in the outlet pipe 10 is thereafter partly closed, and the valve means 15 adjacent to the upper tank 13 opened. Liquid will now flow in direction towards the lower tank 11, and also fill the chamber 9, and the lower valve means 17 can now be arranged substantially completely closed for a shorter period of time. The pressure of the liquid column in the chamber 9 now causes pressure application of the flexible part against the core 4, and thus also against the part of the profiled tubular member 1 which as a first step only surrounds a limited portion of the conical part of the core 4, whereby said portion of the tubular element 1 is formed into a conical shape. This change in the shape is made possible due to changes in the width and/or the depth of existing profilings 2, 2', 3, 3' in the tubular member 1.

When a first forming operation has been performed in the described manner, the upper valve means 15 is closed again, and the lower valve means 17 is completely opened, whereby previously described vacuum effect is caused with regard to the chamber 9, i.e. the flexible part 8 is moved from a position in contact against the core 4 and the tubular member 1 to the previously described position in contact with the tubular part 7.

The abutment member 16 is now moved upwardly, thereby also moving the profiled tubular element 1 a corresponding distance upwardly, whereafter the previously described operation is repeated. These operations are repeated until the abutment member 16 is located adjacent to the part of the core 4, where the conical part of the core 4 starts, and this conical part should obviously have a length corresponding to, or exceeding, the total length of the profiled tubular member 1.

The fact that the forming operation is performed gradually, as successive steps, overcomes the otherwise existing risk that the profilings 2, 2', 3, 3' might not enter the grooves 6, 6' of the core 4, and this risk is considerable adjacent the end portion of the tubular member 1 having the smallest diameter after forming. By performing the forming operation as a number of successive steps, whereby a certain portion of the tubular member 1 is gradually reduced in diameter, entering of the profilings 2, 2', 3, 3' into the existing grooves 6, 6' at the core 4 is assured. The number of forming operations is obviously related to the conicity of the end product, but in order to obtain maximum safety, the tubular member 1 should be moved such a distance between each forming operation in relation to the core 4, that the profilings 2, 2', 3, 3' are located adjacent to the grooves 6, 6' in the core 4 into which they should enter in the next forming operation.

Figure 5:
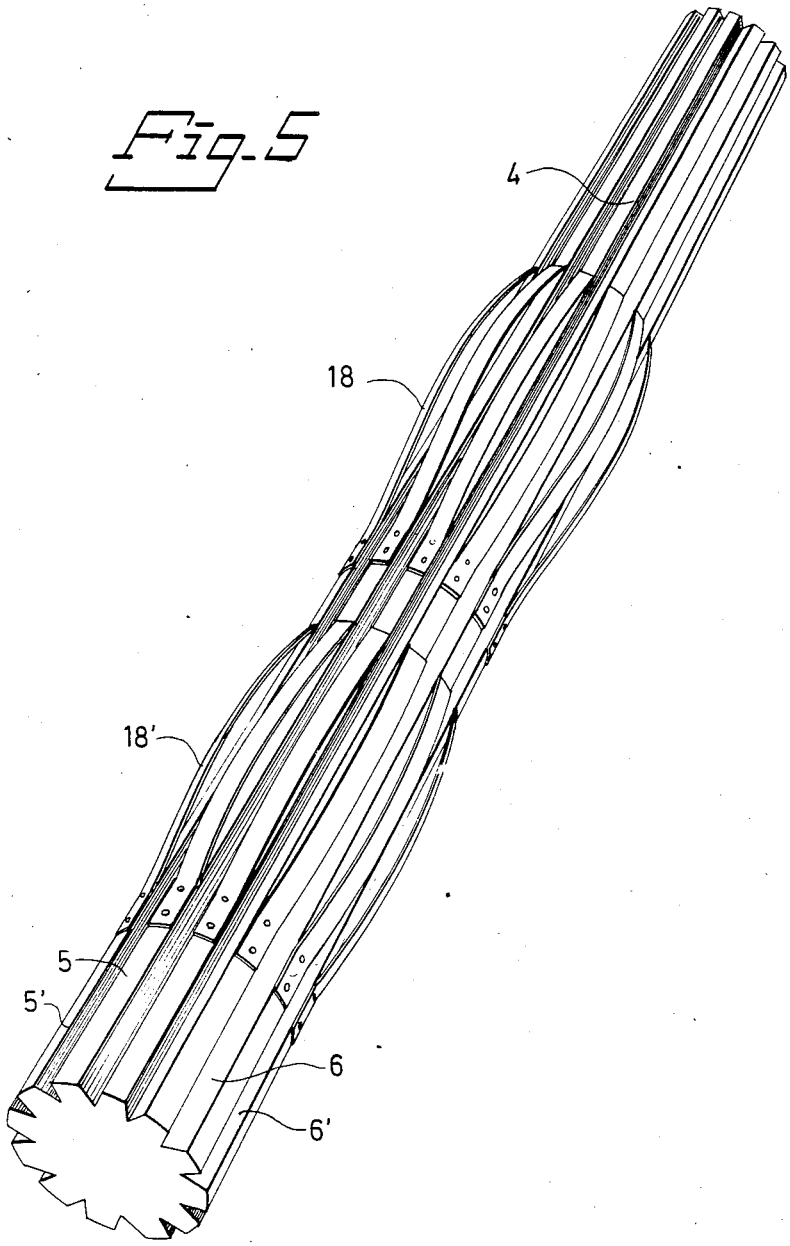
FIG. 5 is a perspective view of a first embodiment of a core, used in the forming operation to produce a conical tubular member in accordance with the invention.

In order to reduce the number of forming operations, it is also possible to use alternative solutions. An example of such a modification is shown in FIG. 5, according to which the core 4 has been modified with a number of guiding members 18, 18', extending bowshaped from the outer contact surfaces 5, 5' of the core 4. Said guiding members 18, 18' can comprise members similar to blade springs, attached at one end portion, and arranged so that when compressed they form a part of the contact surface 5, 5' to which each guiding member 18, 18' is attached. Said guiding members 18, 18' can in certain cases reduce the number of forming operations to one only, which obviously reduces the manufacturing cost considerably.

A further alternative method to reduce the number of forming operations exists in the possibility to divide the chamber 9 into a number of sections, divided from each other in the longitudinal direction of the core 4. For example, such a division can be arranged in such a way, that a number of individually expandable sections are provided within the tubular part 7, comparable to tubes of the type used in vehicle tires, in adjacent positions to each other. Said expandable sections are preferably first evacuated of the medium used when the profiled tubular member 1 is inserted into a position embracing the core 4. Thereafter a successively performed forming operation is initiated, by expanding the section most adjacent to the larger part of the conical core 4 by means of supplied gaseous or liquid medium, and following sections are thereafter successively filled with gaseous or liquid medium under pressure, whereby are existing profilings 2, 2', 3, 3' are gradually pressed into the grooves 6, 6' of the core 4, and the risk of non-entering of said profilings 2, 2', 3, 3' into co-acting grooves 6, 6' in the core 4 is substantially completely eliminated. This method can advantageously be combined with the type of a core 4 as described with reference to FIG. 5, in order to obtain even higher security for a correctly performed forming operation.

It should also be mentioned, that the embodiment described with reference to FIG. 6 obviously also can be used with a gaseous medium under pressure, and that the forming operation need not necessarily be performed with the core 4 arranged extending vertically. However, such a position of extension, when using a liquid medium, often results in that the pressure of the liquid column is satisfactory for performing a complete forming operation.

An interesting aspect related to the forming method according to the present invention is also, that the profiled tubular member 1 can be manufactured from sheet metal having through perforations. Mechanical forming operations, e.g. of the type disclosed in the prior art, prevents the use of perforated sheet metal, since perforations prevent the use of mechanically applied rollers or similar types of shaping tools.

Figure 7:
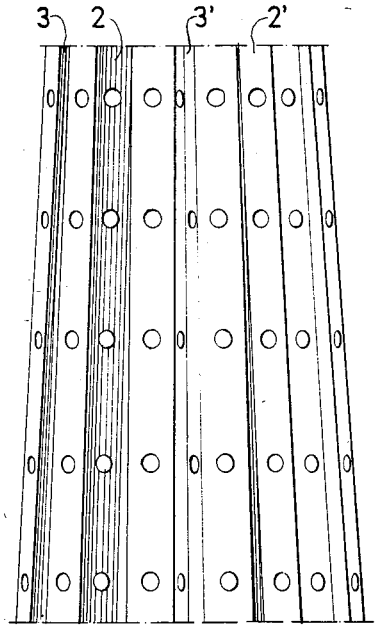
FIG. 7 is a side elevational view of a conical tubular member, slightly modified in relation to the conical member shown in FIGS. 3 and 4.

An example of such a conical perforated tubular member is disclosed in FIG. 7, and the advantages of using perforated sheet metal is firstly that complete through ventilation is achieved, which substantially completely eliminates the risk of damage through corrosion associated with metallic poles and masts, arranged with a solid surrounding surface, and secondly, such a mast or pole can also be climbed using conventional climbing irons, if the seizing members are arranged with a surrounding hose or layer of rubber or similar flexible material, enters the perforations when climbing, thereby causing an extremely safe grip. Said safe grip is further accentuated by the conical shape, which means that a pole or a mast has a gradually increasing cross-section in the downward direction. A further advantage in using perforated sheet metal as base material is, apart from the reduction in weight, that a pole or mast located adjacent to a road surface, and thus made subject to light from moving light sources (vehicles), also results in a "light organ effect", which makes it extremely easy to observe. This effect is extremely significant, and a passing driver in a vehicle can not fail to notice the pole or the mast when driving under bad light conditions. As a result, good safety is achieved for observing poles or masts before they are passed by vehicles.

The basic embodiments discussed above with reference to the possibility to use perforated sheet metal, also includes other types of material, such as wire mesh materials. Such materials can advantageously be formed according to the method of manufacture previously discussed, which makes it possible to manufacture poles, masts, or similar objects having complete through visibility. By a suitable choice of mesh size and wire diameter, it is also possible to provide desired tensile strength properties.

An interesting aspect of conical tubular members, manufactured according to the present invention, is that existing profilings 2, 2', 3, 3' not only serve as elements improving rigidity, but also facilitate forming into a conical end product. At any choosen diameter, a conical tubular member according to the present invention has a considerably larger total circumference than a conical tubular member having a cylindrical outer surface. By varying the depth and the number of profilings 2, 2', 3, 3' used, it is thus possible to accomplish basically any desired total surrounding length of material, and this length is also maintained at every point in longitudinal direction of the end product.

It should be emphasized, that the examples previously given relating to manufacturing technique when using the method according to the present invention obviously can be varied further in a number of ways, while maintaining the characteristic features related to each example, which are, that as a first step a cylindrical tubular member 1 is formed, having a least one longitudinally extending profiling 2, 2', 3, 3' directed towards the internal surface of the member 1, and that said member in a subsequent step is placed over a conical core 4 having grooves for the profilings 2, 2', 3, 3' in the member 1, and that said member by means of pneumatic or hydraulic force is formed to a shape corresponding to the core 4, and that the change in form is accomplished by a change in the shape of existing profilings 2, 2', 3, 3'.

The present invention is thus in no way restricted to the shown and described examples of embodiments, but can be varied within the scope of the invention and the following claims.

I claim:

1. A method for the manufacture of a conical tubular member comprising:

forming a tubular member having a substantially non-tapered configuration along its length and at least one profiled groove extending longitudinally along the length of the tubular member and inwardly with respect to the surface thereof;

placing said tubular member in at least partial surrounding relationship onto a conical mandrel having at least one groove in the outer surface extending along the length thereof corresponding to said profiled groove in said tubular member to receive said profiled groove therein;

maintaining said tubular member in substantially fixed position on said mandrel; and applying a fluid pressure force to the exterior of said tubular member to compress said tubular member onto said mandrel and said at least one profiled groove into said at least one groove in the mandrel to conform said tubular member to the conical shape of said mandrel by changing the cross-section of said at least one profiled groove as it is pressed into said at least one groove in the mandrel.

2. A method as claimed in claim 1 wherein said tubular member forming step comprises:

providing a strip-shaped member having longitudinal edges with said longitudinal profiled groove therein;

bending said strip-shaped member into a tubular configuration with the longitudinal edges in contacting relationship; and joining said longitudinal edges together.

3. A method as claimed in claim 2 wherein said application of fluid pressure comprises:

enclosing at least said part of the tubular member in surrounding relationship on the mandrel within a flexible force applying member; and applying said fluid pressure to the exterior of said flexible force applying member to compress said flexible force applying member onto said tubular member to substantially conform the tubular member to the conical shape of the mandrel.

4. A method as claimed in claim 2 and further comprising:

guiding said tubular member on said mandrel during the formation of the conical tubular member.

5. A method as claimed in claim 4 wherein a plurality of profiled grooves are provided in said tubular member and a plurality of corresponding grooves are provided in said mandrel.

6. A method as claimed in claim 1 wherein said application of fluid pressure comprises:

enclosing at least said part of the tubular member in surrounding relationship on the mandrel within a flexible force applying member; and applying said fluid pressure to the exterior of said flexible force applying member to compress said flexible force applying member onto said tubular member to substantially conform the tubular member to the conical shape of the mandrel.

7. A method as claimed in claim 1 wherein the application of said fluid pressure comprises a series of successive steps comprising:

after a first application of fluid pressure in a first position, moving said tubular member a certain distance along said mandrel from the larger portion toward the smaller portion thereof to a second position;

maintaining said tubular member in said second position; and repeating said moving and fluid pressure applying steps in successive steps until the desired length of the tubular member is shaped to conform to the conical shape of the mandrel and the cross-section of said at least one profiled groove is successively changed so that the profiled groove projects into the tubular member a greater distance at the smaller portion than at the larger portion thereof.

8. A method as claimed in claim 1 and further comprising:

guiding said tubular member on said mandrel during the formation of the conical tubular member.

9. The method as claimed in claim 1 wherein a plurality of profiled grooves are provided in said tubular member and a plurality of corresponding grooves are provided in said mandrel.

* * * * *